US009828196B2

(12) United States Patent
Harada

(10) Patent No.: US 9,828,196 B2
(45) Date of Patent: Nov. 28, 2017

(54) SHEET STACKING APPARATUS AND IMAGE FORMING APPARATUS

(71) Applicant: CANON KABUSHIKI KAISHA, Tokyo (JP)

(72) Inventor: Yuko Harada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/004,770

(22) Filed: Jan. 22, 2016

(65) Prior Publication Data

US 2016/0214811 A1 Jul. 28, 2016

(30) Foreign Application Priority Data

Jan. 28, 2015 (JP) ..... 2015-013803

(51) Int. Cl.
*B65H 1/08* (2006.01)
*B65H 1/26* (2006.01)

(52) U.S. Cl.
CPC ..... *B65H 1/266* (2013.01); *B65H 1/08* (2013.01); *B65H 2402/64* (2013.01); *B65H 2403/5331* (2013.01); *B65H 2403/541* (2013.01); *B65H 2405/113* (2013.01); *B65H 2405/1117* (2013.01); *B65H 2601/524* (2013.01)

(58) Field of Classification Search
CPC .... B65H 1/266; B65H 1/08; B65H 2405/1117
See application file for complete search history.

(56) References Cited

U.S. PATENT DOCUMENTS 4,280,692 A * 7/1981 Hutchinson ..... B65H 1/04 271/127
4,582,314 A * 4/1986 Yamamoto ..... B65H 1/02 271/127
5,222,725 A * 6/1993 Kasahara ..... B65H 1/266 271/127
5,338,021 A * 8/1994 Shirai ..... B41J 11/58 271/127
5,564,690 A * 10/1996 Oshida ..... B65H 1/12 271/127
7,448,613 B2 * 11/2008 Takahashi ..... B65H 1/12 271/157
7,540,493 B2 * 6/2009 Konishi ..... B65H 1/12 271/157
7,708,265 B2 * 5/2010 Kusama ..... G03G 15/6511 271/117
7,926,805 B2 * 4/2011 Ueyama ..... B65H 1/266 271/145

FOREIGN PATENT DOCUMENTS

JP 2004-323125 A 11/2004
JP 2007-197204 A 8/2007
JP 2012-201473 A 10/2012
JP 2013-112426 A 6/2013

* cited by examiner

*Primary Examiner* — Jeremy R Severson
(74) *Attorney, Agent, or Firm* — Canon U.S.A., Inc. IP Division

(57) ABSTRACT

A cassette in which sheets are stacked is electable from an apparatus main body. An intermediate plate is provided in the cassette that is movable to raise and lower the stacked sheets. A securing member that restricts the cassette from being raised when at a restricted position is provided, where, in response to movement of ejecting the stacking unit from the apparatus main body, the securing member moves to a permitted position that enables the movable member to rise.

17 Claims, 10 Drawing Sheets

SHEET STACKING APPARATUS AND IMAGE FORMING APPARATUS

BACKGROUND

Field

Aspects of the present invention generally relate to a sheet stacking apparatus in which sheets are stacked and an image forming apparatus including the sheet stacking apparatus.

Description of the Related Art

In a conventional image forming apparatus, a sheet stacking apparatus in which sheets that are fed to the image forming apparatus are stacked is provided so as to be capable of being inserted into and ejected from an apparatus main body.

The sheet stacking apparatus is provided with an intermediate plate movable with respect to the sheet stacking apparatus. The intermediate plate raises sheets with a variety of elevating devices and brings the sheets into contact with a feeding roller, thereby feeding the sheets to the image forming apparatus.

However, because the intermediate plate is provided so as to be movable with respect to the sheet stacking apparatus, vibrations or an impact when the apparatus main body is transported may scratch or damage the intermediate plate or a peripheral component.

In view of the above, Japanese Patent Laid-Open No. 2007-197204 discloses an example in which the intermediate plate is secured with a cushioning material such as polystyrene foam or corrugated cardboard, or an intermediate-plate retainer for use in transportation.

SUMMARY

Aspects of the present invention generally provide an apparatus that alters restrictions on a movable member placed by a restricting member in response to movement of ejecting a stacking unit from an apparatus main body.

A sheet stacking apparatus includes a stacking unit in which sheets are stacked, wherein the stacking unit is ejectable from an apparatus main body, a movable member, provided in the stacking unit, movable to raise and lower the stacked sheets, and a restricting member that restricts the movable member from being raised when at a restricted position. When, in response to movement of ejecting the stacking unit from the apparatus main body, the stacking unit is ejected from the apparatus main body with the restricting member at the restricted position, the restricting member moves from the restricted position to a permitted position at which the movable member is permitted to rise.

Further features of aspects of the present invention will become apparent from the following description of exemplary embodiments with reference to the attached drawings.

DESCRIPTION OF THE EMBODIMENTS

Exemplary embodiments of aspects of the present invention will hereinafter be described in detail by way of example with reference to the drawings. However, the dimensions, materials, shapes, and relative arrangements of components described in the embodiments below can be modified depending on the structures and various conditions of apparatuses to which aspects of the present invention are applied. Accordingly, the scope of the aspects of the present invention is not limited thereto, unless specifically indicated.

First Embodiment

Figure 1:
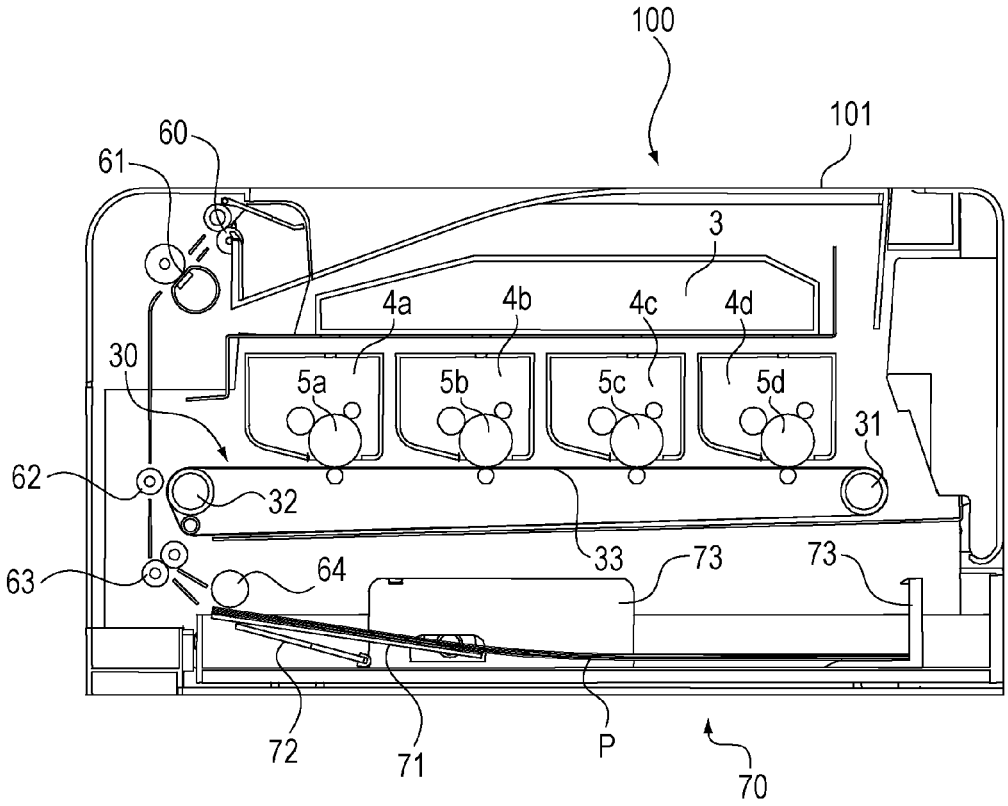
FIG. 1 is a cross-sectional view of the overall structure of an electrophotographic image forming apparatus including a sheet stacking apparatus according to a first embodiment.

A structure of an electrophotographic image forming apparatus (referred to as an image forming apparatus below) 100 including a sheet stacking apparatus according to the first embodiment will be described below with reference to FIG. 1. FIG. 1 is a schematic cross-sectional view of the overall structure of the image forming apparatus.

As shown in FIG. 1, four attachable and detachable process cartridges 4 (4*a*, 4*b*, 4*c*, and 4*d*) are installed with attaching members (not shown) in the image forming apparatus 100.

The process cartridges 4 include respective electrophotographic photosensitive drums (referred to as photosensitive drums below) 5 (5*a*, 5*b*, 5*c*, and 5*d*) as image bearing members. The process cartridges are provided integrally with process units (not shown) that act on the photosensitive drums such as a charging unit, a developing unit, and a cleaning unit around the photosensitive drums.

A scanner unit 3 that selectively exposes the photosensitive drums 5 to light in accordance with image information and forms a latent image on the photosensitive drums 5 is provided above the process cartridges 4.

An intermediate transfer unit 30 as an intermediate transfer mechanism that transfers toner images formed on the photosensitive drums 5 is provided below the process cartridges 4. The intermediate transfer unit 30 includes a driving roller 31 and a facing roller 32 that faces a secondary transfer roller 6, and a transfer belt 33 is stretched around the rollers 31 and 32. The transfer belt 33 cyclically runs so as to face and come into contact with all the photosensitive drums 5. A voltage is applied to primary transfer rollers that face the respective photosensitive drums with the transfer belt 33 interposed between, and the toner images formed on the photosensitive drums 5 are thereby superposed onto the transfer belt 33 from the photosensitive drums 5 for primary transfer. A voltage is applied to the facing roller 32 arranged in the inner side of the transfer belt 33 and the secondary transfer roller 62, and the toner images on the transfer belt 33 are collectively secondary-transferred to a sheet P.

Thus, the process cartridges 4, the scanner unit 3, and the intermediate transfer unit 30 constitute an image forming part that forms an image on the sheet.

A cassette 70 as the sheet stacking apparatus in which sheets P are stacked is installed so as to be electable in a lower portion of the image forming apparatus 100.

The cassette 70 is provided with an intermediate plate 71 in which the sheets P are stacked, an elevating device 72 that raises and lowers the intermediate plate 71, and a sheet restricting member 73 that restricts peripheral faces of the stacked sheets P. The intermediate plate 71 is a movable member provided in the cassette 70 to be movable so as to raise and lower the sheets stacked in the interior of the cassette 70. The intermediate plate 71 is movable so as to rise on the downstream side in the direction of feeding the sheet P. The elevating device 72 may be an elastic member (urging member) such as a spring, or driven to be raised or lowered by, for example, a driving unit. The sheet restricting member 73 restricts the peripheral face on the trailing-end side in the direction of feeding the sheet and the peripheral faces in a width direction perpendicular to the direction of feeding the sheet.

The sheets P stacked in the cassette 70 are brought into contact with a feeding roller 64 by being raised on the downstream side in the feeding direction by the intermediate plate 71 and separately fed by the feeding roller 64 as a feeding unit one by one. The separately fed sheet P is conveyed to a secondary transfer part at which the facing roller 32 faces the secondary transfer roller 62 in a timed relation to the images on the transfer belt 33 by conveying rollers 63. The images are transferred to the sheet P at the secondary transfer part, and the sheet P is conveyed to fixing rollers 61 to fix the images thereon. The sheet P on which the images are fixed is conveyed to an upper portion of the image forming apparatus 100 by discharging rollers 60.

A mechanism for securing the intermediate plate during transportation, which is a feature of the embodiment, will now be described with reference to FIGS. 2A to 6B.

Figure 2A:
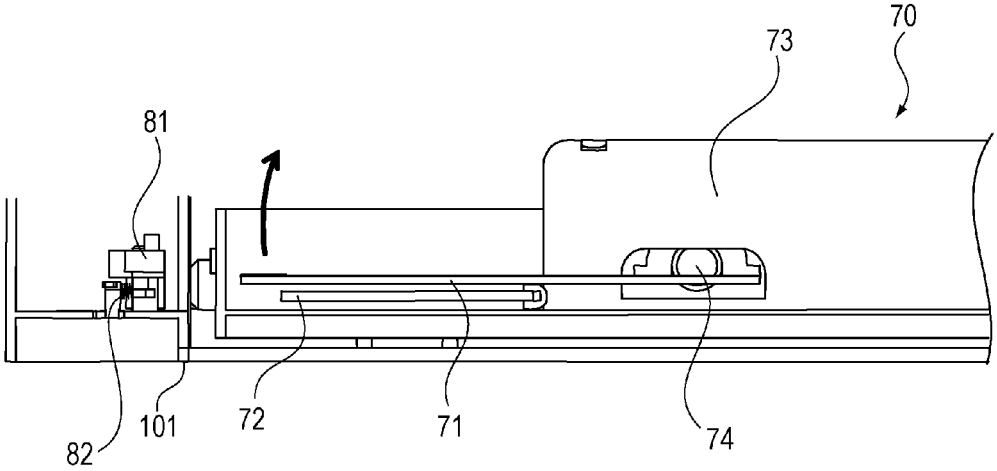
FIGS. 2A and 2B are cross-sectional views of a mechanism for securing an intermediate plate of the sheet stacking apparatus according to the first embodiment.
Figure 2B:
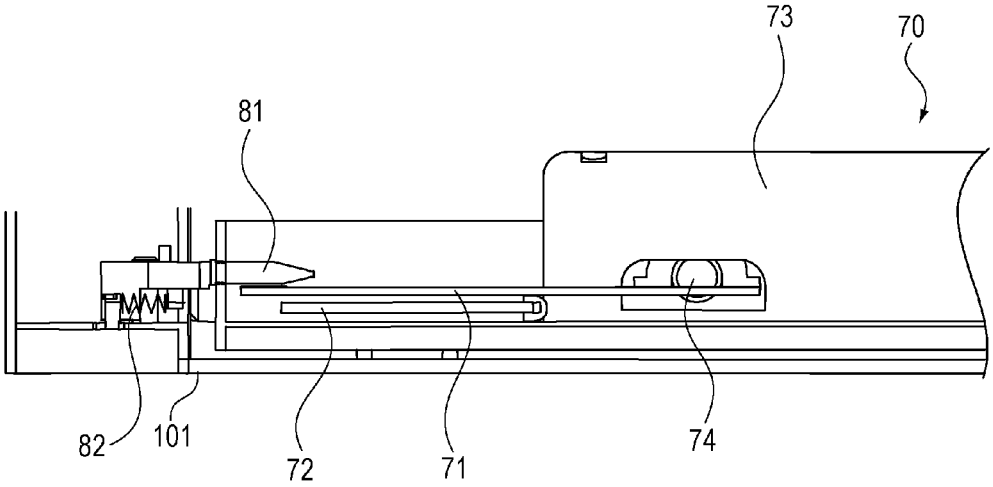

Conditions of the mechanism for securing the intermediate plate during transportation and the other cases will be first described with reference to FIGS. 2A and 2B. FIGS. 2A and 2B are enlarged cross-sectional views of part of the mechanism for securing the intermediate plate in FIG. 1. FIG. 2A shows conditions of cases other than transportation such as use by a user. FIG. 2B shows conditions when the main body is transported.

As shown in FIG. 2A, during use by a user, a securing member 81 that secures the intermediate plate 71 is contained in the interior of the apparatus main body 101 of the image forming apparatus 100 so as not to interfere with movement of the intermediate plate 71. The intermediate plate 71 is supported so as to be pivotable in the direction of an arrow on an intermediate-plate fulcrum 74 provided in the cassette 70 and freely pivots in a predetermined range.

In contrast, as shown in FIG. 2B, during transportation, the securing member 81 protrudes from the apparatus main body 101 to suppress the rise of the intermediate plate 71 and restricts pivoting of the intermediate plate 71 on the intermediate-plate fulcrum 74.

Figure 3A:
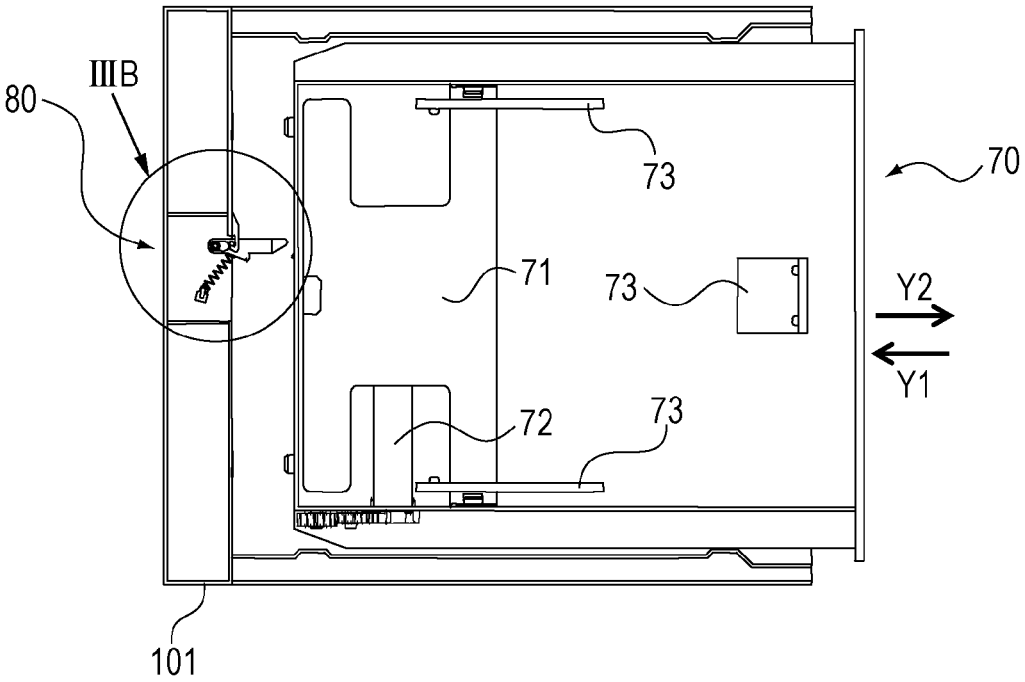
FIG. 3A is a top view of the sheet stacking apparatus according to the first embodiment before transportation.
Figure 3B:
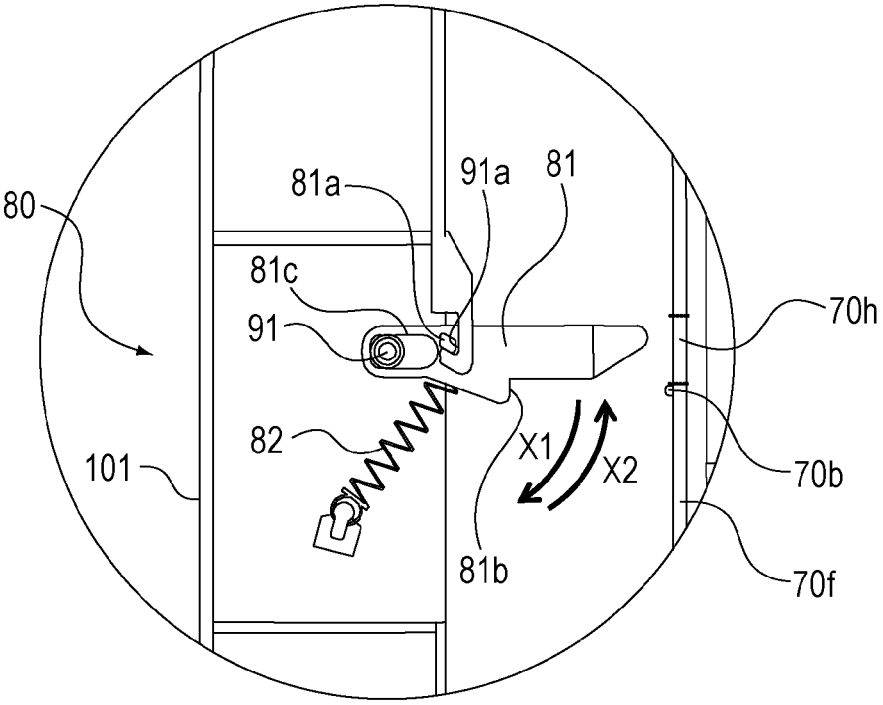
FIG. 3B is an enlarged view of a main part IIIB around a securing member shown in FIG. 3A.
Figure 4A:
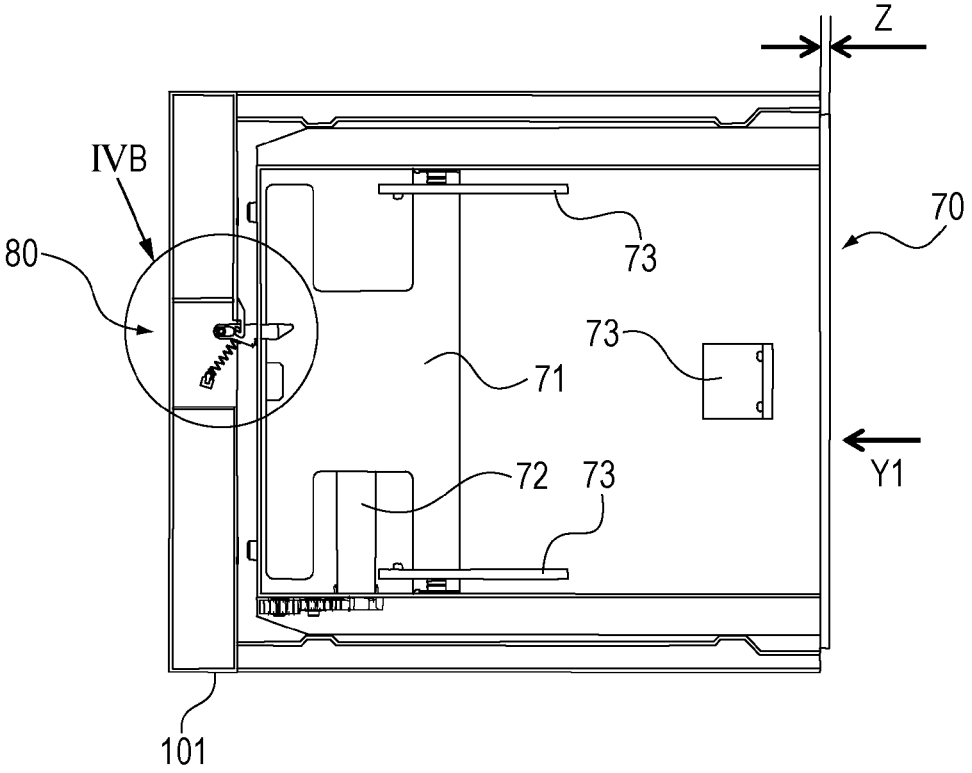
FIG. 4A is a top view of the sheet stacking apparatus according to the first embodiment just before transportation.
Figure 4B:
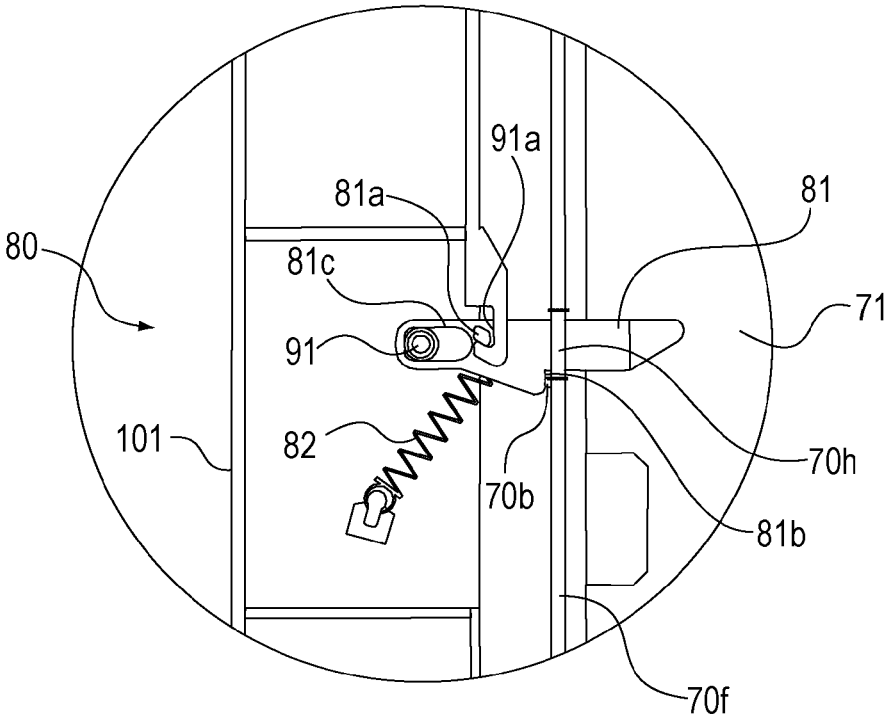
FIG. 4B is an enlarged view of a main part IVB around the securing member shown in FIG. 4A.
Figure 5A:
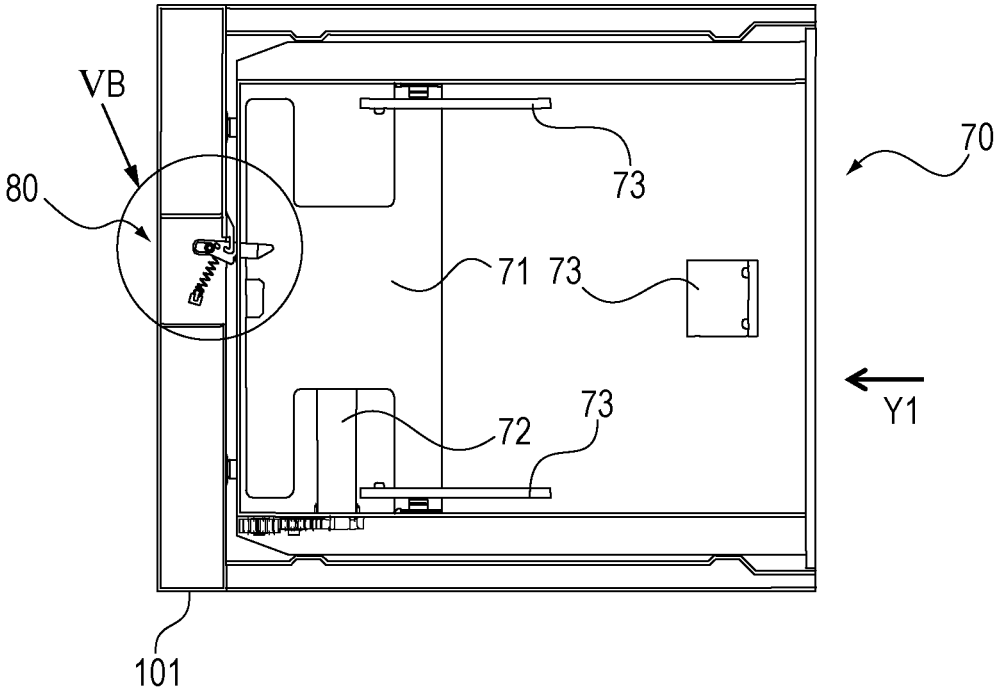
FIG. 5A is a top view of the sheet stacking apparatus according to the first embodiment during transportation.
Figure 5B:
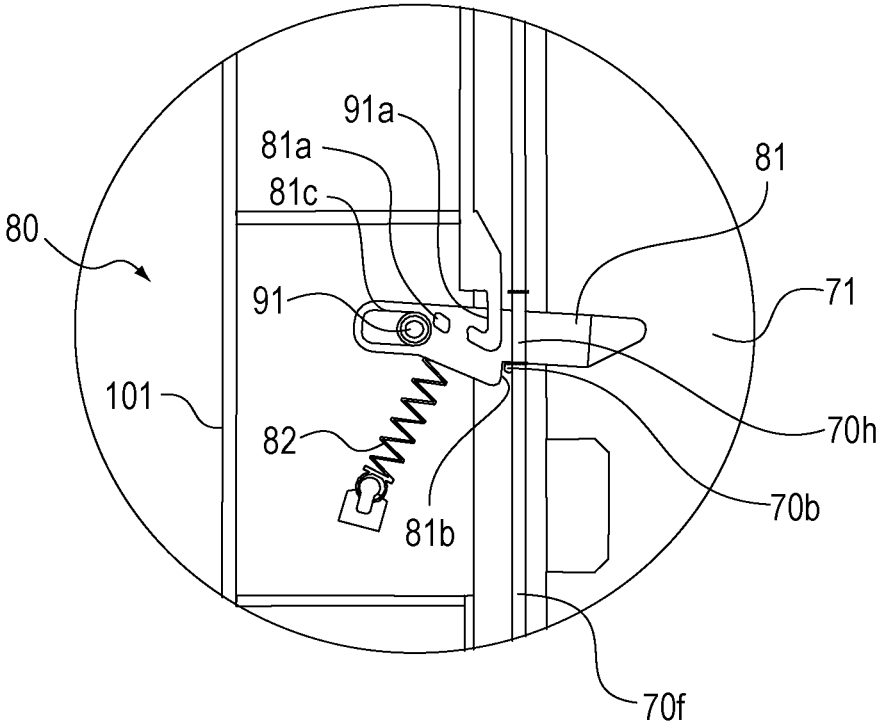
FIG. 5B is an enlarged view of a main part VB around the securing member shown in FIG. 5A.
Figure 6A:
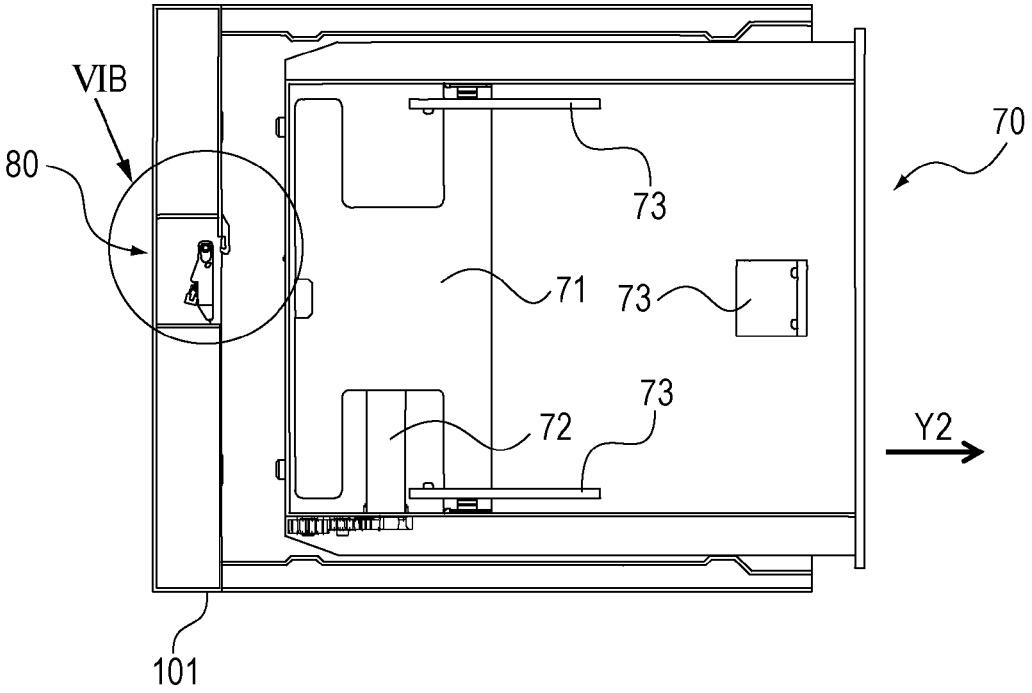
FIG. 6A is a top view of the sheet stacking apparatus according to the first embodiment after transportation.
Figure 6B:
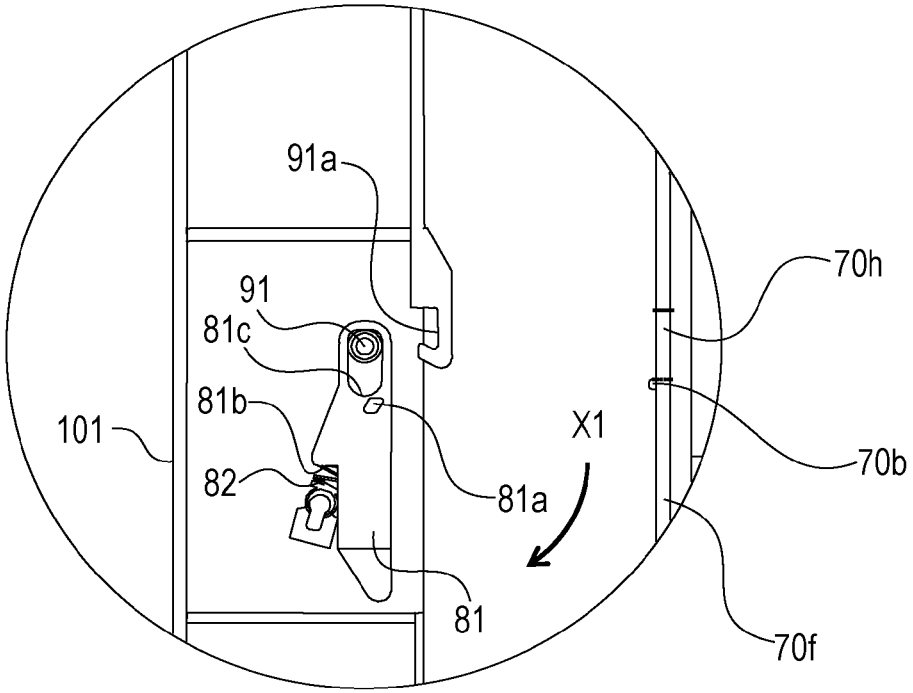
FIG. 6B is an enlarged view of a main part VIB around the securing member shown in FIG. 6A.

Movement of the securing member 81 will be next described in detail with reference to FIGS. 3A to 6B. FIGS. 3A to 6B are structure diagrams of main parts showing the relationship between the securing member and the cassette electable from the apparatus main body, in which FIGS. 3A, 4A, 5A, and 6A are top views, and FIGS. 3B, 4B, 5B, and 6B are enlarged views of main parts IIIB, IVB, VI, and VIB around the securing member shown in FIGS. 3A, 4A, 5A, and 6A. FIGS. 3A and 3B are before transportation; FIGS. 4A and 4B are just before the transportation; FIGS. 5A and 5B are during the transportation; FIGS. 6A and 6B are after the transportation.

The movement of the securing member 81 before transportation will be described with reference to FIGS. 3A and 3B. The arrow Y1 shown in FIG. 3A indicates the direction of inserting, the cassette 70 into the apparatus main body 101.

As shown in FIG. 3B, an intermediate-plate securing unit 80 is formed of the securing member 81 and an urging member 82. The securing member 81 is a restricting member that restricts the intermediate plate 71 from being raised when at a restricted position (condition in FIGS. 5A and 5B). The urging member 82 is an urging member that elastically urges the securing member 81 toward a permitted position at which the intermediate plate 71 is permitted to rise (condition in FIGS. 6A and 6B).

The securing member 81 is provided with a first posture holding portion 81*a* as a first engaged portion included in a first holding device and a second posture holding portion 81*b* as a second engaged portion included in a second holding device. As shown, in FIG. 3A, the first holding device holds, against an urging force of the urging member 82, the securing member 81 at a standby position at which the securing member 81 is on standby to restrict the intermediate plate 71 from being raised when the cassette 70 is ejected from the apparatus main body 101. The first holding device includes a main-body-side posture holding portion 91*a* as a first engaging portion provided in the apparatus main body 101 and the first posture holding portion 81*a* that engages with the main-body-side posture holding portion 91*a* and is provided in the securing member 81. As shown in FIG. 3B, the first holding device holds, against the urging force of the urging member 82, the securing member 81 at the standby position at which the securing member 81 is on standby to restrict the intermediate plate 71 from being raised by engaging the main-body-side posture holding portion 91*a* with the first posture holding portion 81*a*.

The securing member 81 has an elliptical hole 81*c* with which a cylindrical boss 91 provided on the apparatus main body is engaged. The elliptical hole 81*c* allows the securing member 81 to be supported so as to be pivotable on the boss 91 in the directions of arrows X1 and X2 with respect to the apparatus main body 101 and to be movable in the directions of inserting and ejecting the cassette 70 (directions of arrows Y1 and Y2) with respect to the apparatus main body 101.

The securing member 81 is urged to pivot on the boss 91 in the direction of arrow X1 by the urging member 82. The first posture holding portion 81*a* of the securing member 81 is then engaged with the main-body-side posture holding portion 91*a* on the side of the apparatus main body 101. This enables the securing member 81 to maintain, against the urging force of the urging member 82, posture thereof at the standby position at which the securing member 81 awaits insertion of the cassette 70 (position shown in. FIGS. 3A and 3B).

The movement of the securing member 81 just before transportation will be next described with reference to FIGS. 4A and 4B. FIG. 4A is a diagram of when the cassette 70 is inserted further into the apparatus main body 101 than in FIG. 3A and shows a condition in which a distance Z remains before the cassette 70 is completely installed in the apparatus main body 101.

As shown in FIG. 4B, a hole 70*h* in the form of an opening is defined through a wall surface 70*f* of the cassette 70. This enables the securing member 81 held at the standby position (position shown in FIGS. 3A and 3B) to pass through the hole 70*h* and secure the intermediate plate 71 at the restricted position when the cassette 70 is inserted into the apparatus main body 101. The securing member 81 passes though and fits into the hole 70*h* defined through the wall surface 70*f* of the cassette 70 so as to suppress vibration of the intermediate plate 71. A cassette-side posture holding portion 70*b* as a second engaging portion provided in the cassette 70 is then engaged with the second posture holding portion 81*b* as the second engaged portion provided in the securing member 81. The cassette-side posture holding portion 70*b* and the second posture holding portion 81*b* constitute a second holding device that holds the securing member 81 urged by the urging member 82 at the restricted position (position shown in FIGS. 5A and 5B).

The movement of the securing member 81 during transportation will be next described with reference to FIGS. 5A and 5B. As shown in FIG. 5A, the cassette 70 is completely contained within the apparatus main body 101 during transportation.

As shown in FIG. 5B, the second posture holding portion 81*b* of the securing member 81 and the cassette-side posture holding portion 70*b*, which are engaged at the time shown in FIG. 4B, push the securing member 81 by the distance Z shown in FIG. 4A in the inserting direction (direction of arrow Y1). The securing member 81 thereby moves in the direction of arrow Y1 such that the elliptical hole 81*c* follows the boss 91, and the first posture holding portion 81*a* of the securing member 81 is separated from the main-body-side posture holding portion 91*a* so that the engagement is released.

Because the second posture holding portion 81*b* engages with the cassette-side posture holding portion 70*b*, the securing member 81 is held at the restricted position at which the vibration of the intermediate plate 71 during the transportation is suppressed (intermediate-plate securing position shown in FIG. 5A). Accordingly, the intermediate plate 71 is secured while being restricted to the restricted position by the securing member 81 held at the restricted position.

Conditions of the intermediate-plate securing unit 80 during use by a user after transportation will be finally described with reference to FIGS. 6A and 6B. As shown in FIG. 6A, a user ejects the cassette 70 in the direction of arrow Y2 to stack sheets P in the cassette 70 when the user uses the main body in response to this movement, the second posture holding portion 81*b* of the securing member 81 and the cassette-side posture holding portion 70*b*, which have been engaged at the restricted position shown in FIG. 5A, are separated so that the engagement is released. The securing member 81 on which the urging force is exerted by the urging member 82 pivots in the direction of arrow X1 and is held at a retracted position at which the securing member 81 is engaged with neither the main-body-side posture holding portion 91*a* nor the cassette-side posture holding portion 70*b* (position shown in FIGS. 6A and 6B). The retracted position of the securing member 81 is the permitted position at which the securing member 81 permits the intermediate plate 71 to rise and also a position at which the securing member 81 does not interfere with the rising movement of the intermediate plate 71.

Thus, the intermediate plate 71 is secured at the restricted position, at which rising is restricted, merely by holding the securing member 81 at the standby position and inserting the cassette 70 before transportation of the product. After transportation of the product, the securing member 81 moves to the retracted position merely as a result of a user ejecting the cassette 70 in use. Thereafter, the securing member 81 does not move from the retracted position unless the intermediate plate 71 is intentionally secured.

In other words, according to this embodiment, a user neither takes time and effort to remove the securing member 81 nor is concerned about damaging the cassette 70 caused after forgetting to remove the securing member 81, and need not install a large-scale apparatus, for example, by incorporating a device that removes the securing member 81 with a driving force. Accordingly, this embodiment readily and reliably allows, with a low-cost structure, the intermediate plate 71 to be secured during transportation and to be released from being secured during use by a user.

Although the intermediate-plate securing unit 80 is situated on the apparatus main body and on a downstream side in the direction of inserting the cassette 70 in this embodiment, the embodiment is not limited thereto, and the intermediate-plate securing unit 80 may be situated on an upstream side in the direction of inserting the cassette 70. In addition, the directions of urging the securing member 81 by the urging member 82 are not necessarily the directions of arrow X1 and X2.

Second Embodiment

Figure 7A:
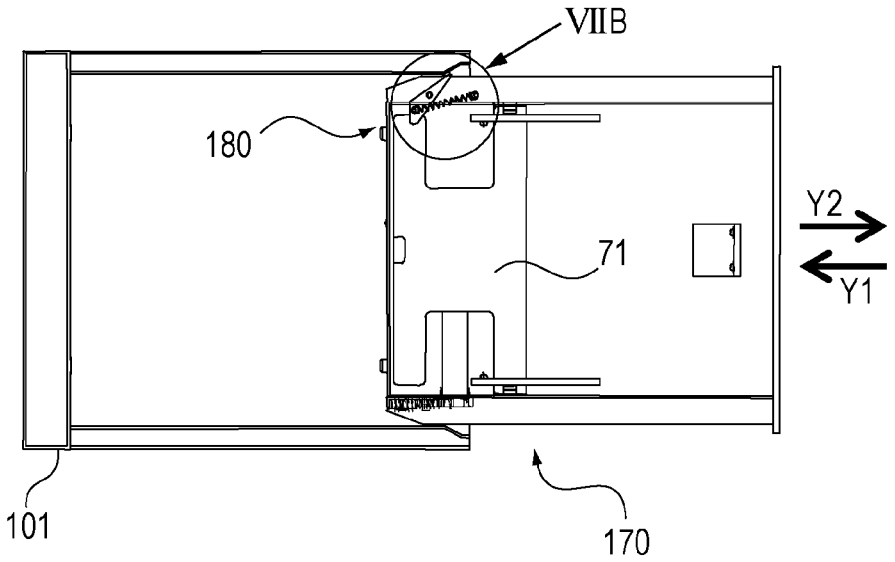
FIG. 7A is a top view of a sheet stacking apparatus according to a second embodiment just before transportation.
Figure 7B:
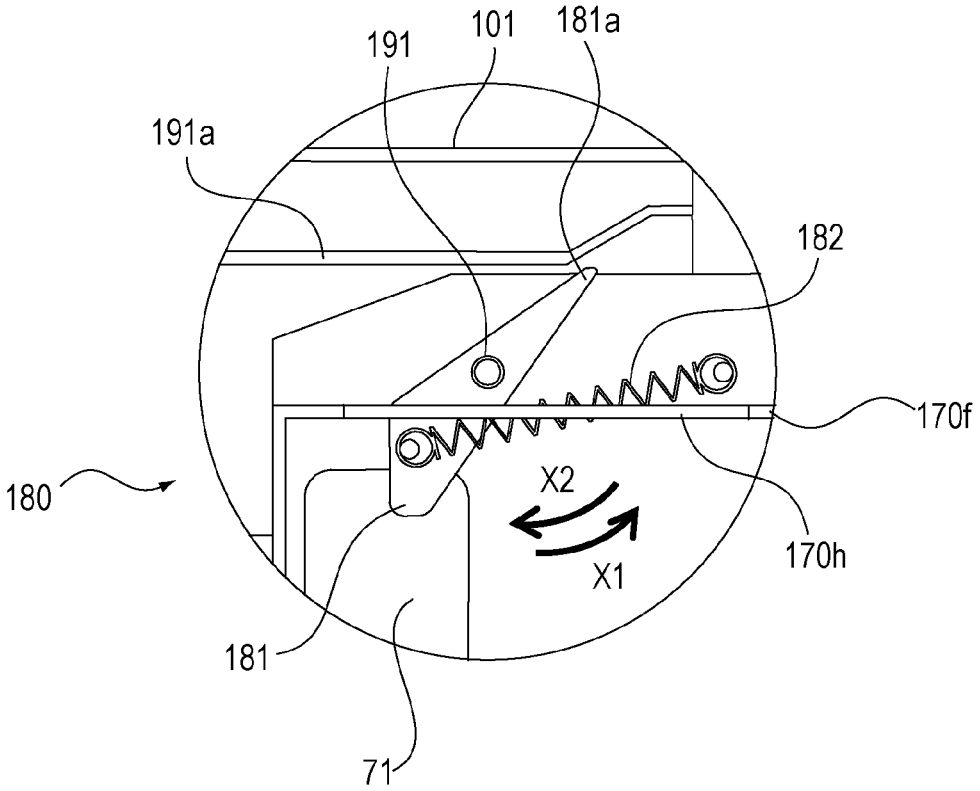
FIG. 7B is an enlarged view of a main part VIIB around a securing member shown in FIG. 7A.
Figure 8A:
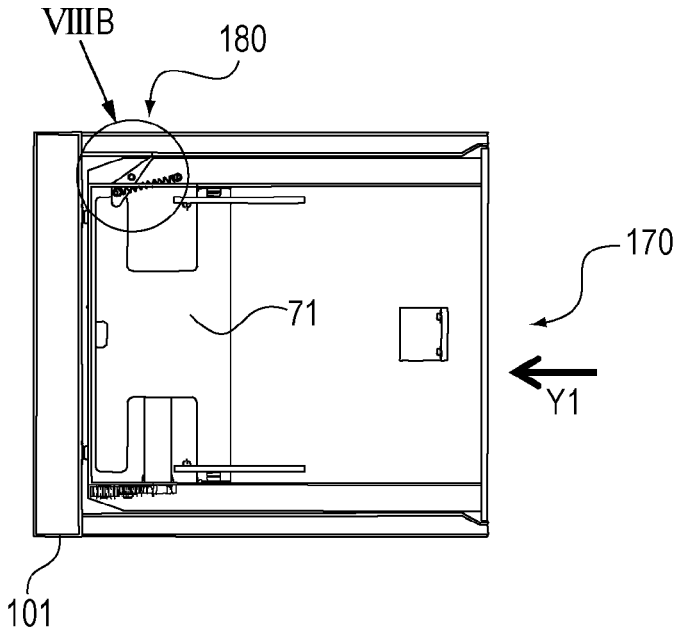
FIG. 8A is a top view of the sheet stacking apparatus according to the second embodiment during transportation.
Figure 8B:
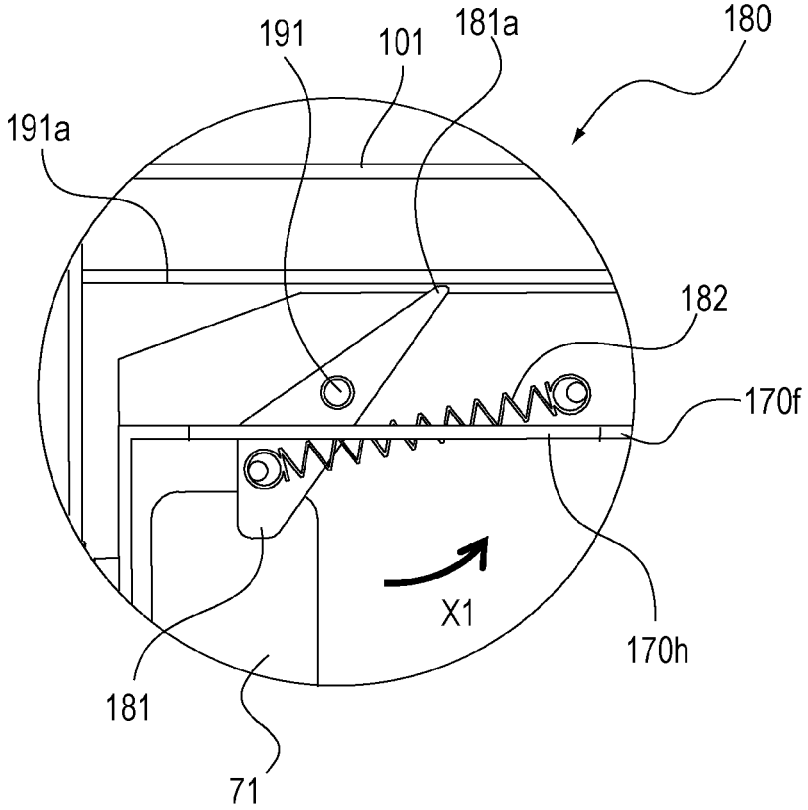
FIG. 8B is an enlarged view of a main part VIIIB around the securing member shown in FIG. 8A.
Figure 9A:
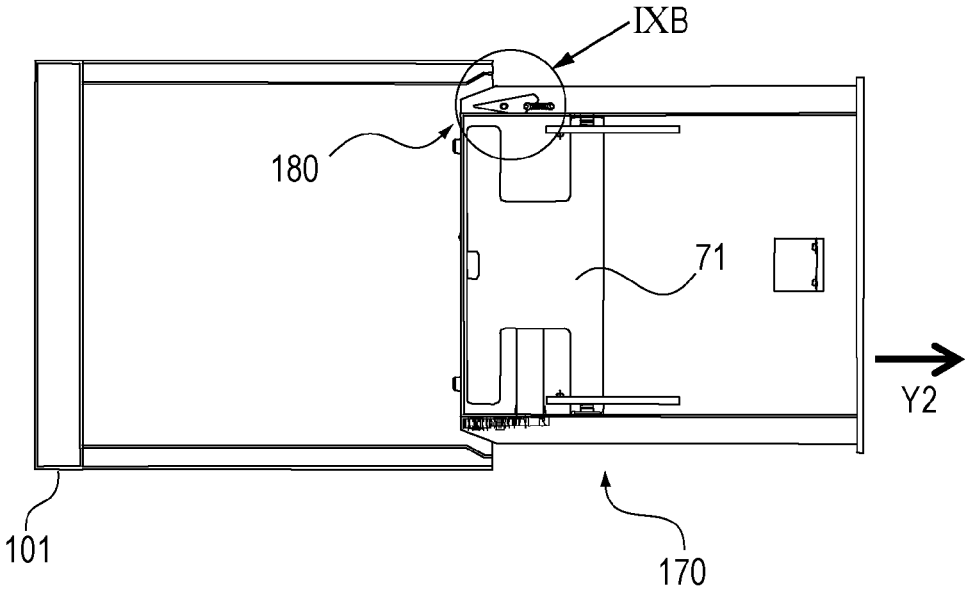
FIG. 9A is a top view of the sheet stacking apparatus according to the second embodiment after transportation.
Figure 9B:
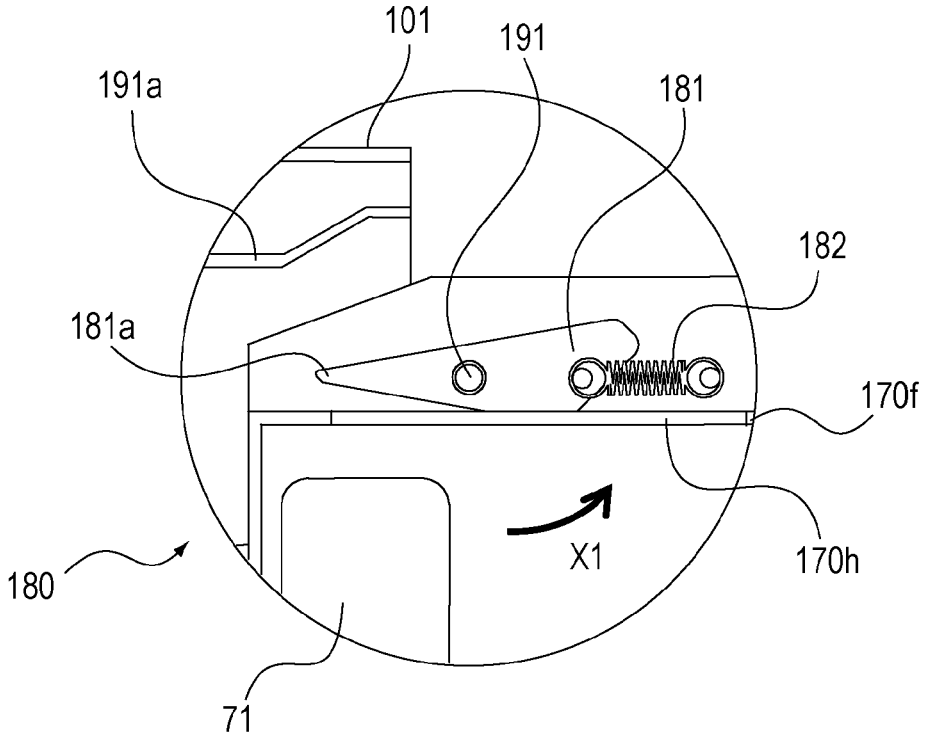
FIG. 9B is an enlarged view of a main part IXB around the securing member shown in FIG. 9A.
Figure 10A:
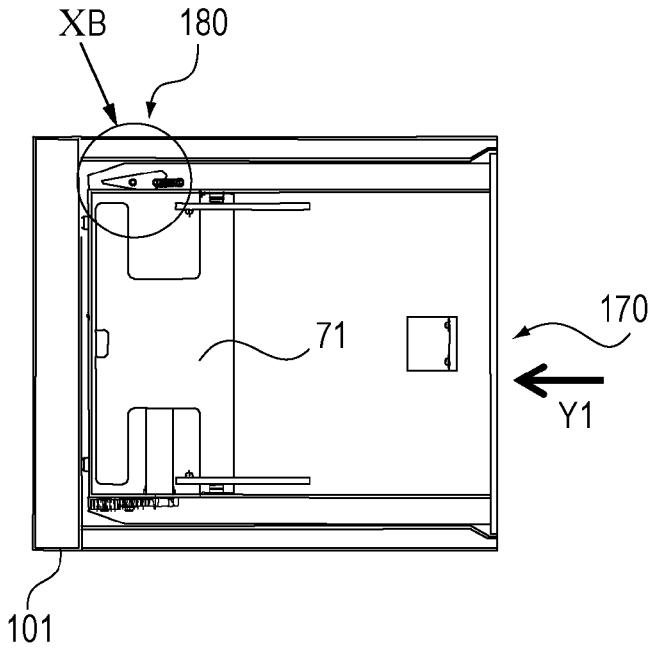
FIG. 10A is a top view of the sheet stacking apparatus according to the second embodiment during use by a user.
Figure 10B:
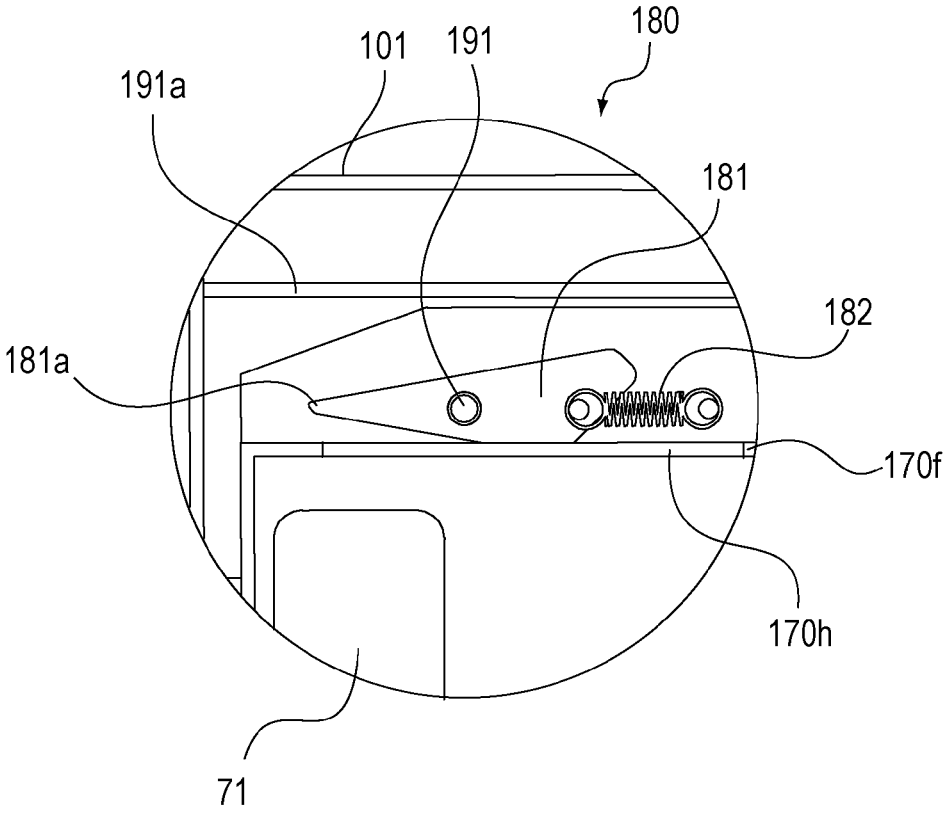
FIG. 10B is an enlarged view of a main part XB around the securing member shown in FIG. 10A.

A sheet stacking apparatus according to the second embodiment will be next described with reference to FIGS. 7A to 10B. FIGS. 7A to 10B are structure diagrams of main parts showing the relationship between the securing member and the sheet stacking apparatus according to this embodiment, in which FIGS. 7A, 8A, 9A, and 10A are top views, and FIGS. 7B, 8B, 9B, and 10B are enlarged views of main parts VIIB, VIIIB, IXB, and XB around the securing member shown in FIGS. 7A, 8A, 9A, and 10A. FIGS. 7A and 7B are just before transportation; FIGS. 8A and 8B are during the transportation; FIGS. 9A and 9B are after the transportation; FIGS. 10A and 10B are during use by a user.

Because basic structures of the apparatus according to this embodiment are the same as the first embodiment described above, redundant portions are omitted. In addition, like numerals designate components having functions like those in the first embodiment described above.

Although the first embodiment describes an exemplary structure when the intermediate-plate securing unit 80 is provided on the apparatus main body side, aspects of the present invention are not limited thereto. The intermediate-plate securing unit 80 may be provided on the side of the cassette 70. The second embodiment will accordingly describe a structure when an intermediate-plate securing unit 180 is provided on the side of a cassette 170.

As shown in FIG. 7A, the cassette 170 is provided with the intermediate-plate securing unit 180 to secure the intermediate plate 71. The arrows Y1 and Y2 shown in FIG. 7A indicate the directions of inserting and electing of the cassette 170, respectively.

As shown in FIG. 7B, the intermediate-plate securing unit 180 includes a securing member 181 and an urging member 182. The securing member 181 is a restricting member that restricts the intermediate plate 71 from being raised when at the restricted position (condition in FIGS. 8A and 8B). The urging member 182 is an urging member that elastically urges the securing member 181 toward the permitted position at which the intermediate plate 71 is permitted to rise (condition in FIGS. 10A and 10B).

The securing member 181 is provided with a posture holding portion 181*a* as an engaging portion included in a holding device. The holding device includes the posture holding portion 181*a* provided in the securing member 181 and a main-body-side posture holding portion 191*a* as an engaged portion that engages with the posture holding portion 181*a* and is provided in the apparatus main body 101. As shown in FIG. 7B, the holding device holds, against the urging force of the urging member 182, the securing member 181 at the restricted position at which the intermediate plate 71 is restricted from being raised by engaging the main-body-side posture holding portion 191*a* with the posture holding portion 181*a*.

The securing member 181 engages with a boss 191 provided on the cassette 170 and is freely pivotable on the boss 191 through a hole 170*h* as an opening bored through a wall surface 170*f* of the cassette 170.

The securing member 181 is urged in the direction of arrow X1 by the urging member 182 with the boss 191 acting as a fulcrum. The cassette 170 is inserted into the apparatus main body 101 with the securing member 181 pulled by being pivoted in the direction of arrow X2. This causes the posture holding portion 181*a* provided in the securing member 181 to engage with the main-body-side posture holding portion 191*a* whereby the securing member 181 is held so as to restrict the intermediate plate 71 to the restricted position.

FIG. 8A is a diagram in which the cassette 170 is completely installed in the apparatus main body 101 after the condition in FIG. 7A. As shown, in FIG. 8B, since the installation is performed with the posture holding portion 181*a* engaging with the main-body-side posture holding portion 191*a*, the securing member 181 continues to be held so as to restrict the intermediate plate 71 to the restricted position without pivoting in the direction of arrow X1.

Conditions of the intermediate-plate securing unit 180 during use by a user after transportation will be next described with reference to FIGS. 9A to 10B.

As shown in FIG. 9A, a user ejects the cassette 170 from the apparatus main body 101 in the direction of arrow Y2 to stack sheets P in the cassette 170 when the user uses the main body. As shown in FIG. 9B, the posture holding portion 181*a* of the securing member 181 and the main-body-side posture holding portion 191*a*, which have been engaged, are then separated, and the securing member 181 on which the urging force is exerted by the urging member 182 pivots in the direction of arrow X1. The securing member 181 then passes through the hole 170*h* bored through the wall surface 170*f* of the cassette 170, moves to the retracted position at which the securing member 181 neither engages with the apparatus main body 101 nor secures the intermediate plate 71 and is held.

As shown in FIG. 10A, when a user stacks the sheet P in the cassette 170 and installs the cassette 170 in the apparatus main body 101 again, the securing member 181 continues to be held at the retracted position. Accordingly, the securing member 181 interferes with neither the movement of rising and lowering the intermediate plate 71 nor the movement of inserting and electing the cassette 170 with respect to the apparatus main body 101.

Thus, the securing member 181 is held so as to restrict the intermediate plate 71 to the restricted position merely by inserting the cassette 170 while the securing member 181 is pivoted in the direction of arrow X2 before transportation of the product. After transportation of the product, the securing member 181 moves to the retracted position merely as a result of a user electing the cassette 170 in use. Thereafter, the securing member 181 does not move from the retracted position unless the intermediate plate 71 is intentionally secured.

In other words, a user neither takes time and effort to remove the securing member 181 nor is concerned about damaging the cassette 170 caused after forgetting to remove the securing member 181 as in the first embodiment, and the intermediate-plate securing unit 180 with a simpler structure than the first embodiment can be provided. Accordingly, this embodiment readily and reliably allows the intermediate plate 71 to be secured during transportation and to be released from being secured during use by a user with a simpler structure and a lower--cost structure than the first embodiment.

Other Embodiments

Although the sheet stacking apparatus in which sheets such as recording paper as recording objects are stacked and contained is described by way of example in the above embodiments, aspects of the present invention are not limited thereto. Aspects of the present invention can achieve the same effects when also applied to a sheet stacking apparatus in which sheets such as manuscripts as viewed objects are stacked and contained.

Although a printer is described as an example of the image forming apparatus in the above embodiments, aspects of the present invention are not limited thereto. Other image forming apparatuses such as a scanner, a copying machine, or a facsimile machine, and another image forming apparatus such as a multifunction printer that combines scanning, copying, and faxing functions are also acceptable. Aspects of the present invention are not limited to an image forming apparatus that uses an intermediate transfer unit, transfers toner images in each color to the intermediate transfer unit in a successively overlapping manner, and transfers the toner images borne by the intermediate transfer unit collectively to a sheet. An image forming apparatus that uses a recording-material bearing member and transfers toner images in each color to a recording material (sheet) borne by the recording-material bearing member in a successively overlapping manner is also acceptable. The same effects can be achieved by applying aspects of the present invention to sheet stacking apparatuses for use in these image forming apparatuses.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application. No. 2015-013803, filed Jan. 28, 2015, which is hereby incorporated by reference herein in its entirety.

What is claimed is:

1. An image forming apparatus comprising:

a stacking unit in which sheets are stacked, wherein the stacking unit is ejectable from an apparatus main body of the image forming apparatus;

a movable member, provided in the stacking unit, movable to raise and lower the stacked sheets;

a restricting member that restricts the movable member from being raised when at a restricted position;

an urging member that elastically urges the restricting member toward a permitted position, and a first holding device that holds, against an urging force of the urging member, the restricting member at a standby position at which the restricting member is on standby to restrict the movable member from being raised when the stacking unit is elected from the apparatus main body; and an image forming part that forms an image on each of the sheets stacked in the stacking unit, wherein the restricting member is provided in the apparatus main body, and wherein, in response to movement of ejecting the stacking unit from the image forming apparatus, when the stacking unit is ejected from the image forming apparatus with the restricting member at the restricted position, the restricting member moves from the restricted position to the permitted position at which the movable member is permitted to rise.

2. The image forming apparatus according to claim 1, wherein the restricting member does not interfere with movement of attaching and detaching the stacking unit with respect to the apparatus main body after moving from the restricted position to the permitted position.

3. The image forming apparatus according to claim 1, wherein the first holding device includes a first engaging portion provided in the apparatus main body and a first engaged portion that engages with the first engaging portion and is provided in the restricting member.

4. The image forming apparatus according to claim 3 further comprising:

a second holding device that holds, at the restricted position, the restricting member urged by the urging member.

5. The image forming apparatus according to claim 4, wherein the second holding device includes a second engaging portion provided in the stacking unit and a second engaged portion that engages with the second engaging portion and is provided in the restricting member.

6. The image forming apparatus according to claim 4, wherein the restricting member is supported by the apparatus main body so as to be pivotable and has an elliptical hole supported so as to be movable, with respect to the apparatus main body, in a direction of inserting the stacking unit, and wherein the restricting member moves from the standby position to the restricted position in response to movement of inserting the stacking unit into the apparatus main body.

7. The image forming apparatus according to claim 1 further comprising:

an elevating device that raises and lowers the movable member.

8. The image forming apparatus according to claim 1, wherein the movable member is movable so as to rise on a downstream side in a feeding direction.

9. A sheet stacking apparatus comprising:

a stacking unit in which sheets are stacked, wherein the stacking unit is ejectable from an apparatus main body;

a movable member, provided in the stacking unit, movable to raise and lower the stacked sheets;

a restricting member that restricts the movable member from being raised when at a restricted position;

an urging member that elastically urges the restricting member toward the permitted position, and a holding device that holds, at the restricted position, the restricting member urged by the urging member, wherein the restricting member is provided in the stacking unit, and wherein, in response to movement of ejecting the stacking unit from the apparatus main body, when the stacking unit is ejected from the apparatus main body with the restricting member at the restricted position, the restricting member moves from the restricted position to a permitted position at which the movable member is permitted to rise.

10. The sheet stacking apparatus according to claim 9, wherein the restricting member does not interfere with movement of attaching and detaching the stacking unit with respect to the apparatus main body after moving from the restricted position to the permitted position.

11. An image forming apparatus comprising:

a stacking unit in which sheets are stacked, wherein the stacking unit is ejectable from an apparatus main body;

a movable member, provided in the stacking unit, movable to raise and lower the stacked sheets;

a restricting member that restricts the movable member from being raised when at a restricted position;

an urging member that elastically urges the restricting member toward the permitted position;

a holding device that holds, at the restricted position, the restricting member urged by the urging member; and an image forming part that forms an image on each of the sheets stacked in the stacking unit, wherein the restricting member is provided in the stacking unit, and wherein, in response to movement of ejecting the stacking unit from the apparatus main body, when the stacking unit is ejected from the apparatus main body with the restricting member at the restricted position, the restricting member moves from the restricted position to a permitted position at which the movable member is permitted to rise.

12. The image forming apparatus according to claim 11, wherein the restricting member does not interfere with movement of attaching and detaching the stacking unit with respect to the apparatus main body after moving from the restricted position to the permitted position.

13. The image forming apparatus according to claim 11, wherein the holding device includes an engaging portion provided in the restricting member and an engaged portion that engages with the engaging portion and is provided in the apparatus main body.

14. An image forming apparatus comprising:

a stacking unit in which sheets are stacked, wherein the stacking unit is ejectable from an apparatus main body;

a movable member, provided in the stacking unit, movable to raise and lower the stacked sheets;

a restricting member that restricts the movable member from being raised when at a restricted position; and an image forming part that forms an image on each of the sheets stacked in the stacking unit, wherein the stacking unit forms an opening through which the restricting member situated at the restricted position passes, wherein the restricting member engages with the opening to suppress vibration of the movable member when the stacking unit is inserted into the apparatus main body, and wherein, in response to movement of ejecting the stacking unit from the apparatus main body, when the stacking unit is ejected from the apparatus main body with the restricting member at the restricted position, the restricting member moves from the restricted position to a permitted position at which the movable member is permitted to rise.

15. The image forming apparatus according to claim 14, wherein the restricting member does not interfere with movement of attaching and detaching the stacking unit with respect to the apparatus main body after moving from the restricted position to the permitted position.

16. The image forming apparatus according to claim 14 further comprising an elevating device that raises and lowers the movable member.

17. The image forming apparatus according to claim 14 further comprising wherein the movable member is movable so as to rise on a downstream side in a feeding direction.

* * * * *